United States Patent [19]

Cacoub

[11] Patent Number: 5,005,762

[45] Date of Patent: Apr. 9, 1991

[54] DECORATION OR UTILITARIAN WATER-USING EQUIPMENT FOR ATMOSPHERE OR LEISURE

[76] Inventor: Alain Cacoub, 94, rue de Sèvres, 75007 Paris, France

[21] Appl. No.: 216,380

[22] Filed: Jul. 8, 1988

[30] Foreign Application Priority Data

Jul. 8, 1987 [FR] France ..... 87 09680

[51] Int. Cl.[5] ..... F21P 7/00

[52] U.S. Cl. ..... 239/20; 239/17; 239/23

[58] Field of Search ..... 239/16, 17, 18, 19, 239/20, 22, 23, 21, 567, 569, 559; 40/406, 407, 411, 412

[56] References Cited

U.S. PATENT DOCUMENTS

| | | | |
|---|---|---|---|
| 3,174,688 | 3/1965 | Chatten | 239/20 |
| 3,189,281 | 6/1965 | Booth . | |
| 3,211,378 | 10/1965 | Zysk | 239/20 |
| 3,212,713 | 10/1965 | Chatten | 239/17 |
| 3,286,927 | 11/1966 | Zysk | 239/23 |
| 3,490,694 | 1/1970 | Ashby . | |
| 3,568,927 | 3/1971 | Scurlock | 239/17 |
| 3,640,463 | 2/1972 | Kawamura et al. | 239/17 |
| 4,088,880 | 5/1978 | Walsh | 239/18 |
| 4,111,363 | 9/1978 | Kawamura et al. | 239/17 |
| 4,265,402 | 5/1981 | Tsai | 239/20 |
| 4,269,352 | 5/1981 | Przystawik | 239/23 |
| 4,294,406 | 10/1981 | Pevnick | 239/20 |
| 4,715,136 | 12/1987 | Fuller et al. | 239/17 |

FOREIGN PATENT DOCUMENTS 1103995 12/1955 France .

*Primary Examiner*—Andres Kashnikow
*Assistant Examiner*—Christopher G. Trainor
*Attorney, Agent, or Firm*—Cushman, Darby & Cushman

[57] ABSTRACT

Utilitarian or decorative equipment for atmosphere or leisure using water coming from a manifold member. The water is used in the form of droplets which are adjustable in volume and at least in fall duration and frequency. The equipment comprises in combination:

a multiplicity of ducts (11) connected to a supply of water, each of the ducts being pierced by outlet ports associated with nozzles (37) for distributing water under pressure by capillarity and in the form of droplets, fine flows, and/or very fine jets of water defining architectural volumes and/or shapes;

at least one collection element (12) beneath the ducts;

a device for controlling the formation and the fall of the droplets, flows, and very fine jets of water (G) from the ducts; and a device for controlling the circulation and the flow of water in the ducts from an overall system for feeding the equipment with water, and, where applicable, from the collection element.

23 Claims, 5 Drawing Sheets

65
66
68
67
69

51
52
10
11
12
56
53
55
54
59

DECORATION OR UTILITARIAN WATER-USING EQUIPMENT FOR ATMOSPHERE OR LEISURE

The invention relates to decorative or utilitarian water-using equipment for atmosphere or leisure.

BACKGROUND OF THE INVENTION

Decorative equipment for atmosphere and using water in the form of jets has been known for a very long time, for example in the form of fountains or other similar structures.

Equipment is also known which uses water drop by drop and, in this respect, specific mention may be made of the following patents: U.S. Pat. Nos. 4,294,406, 4,265,402, BE-A-529 333 and DE-A-3 413 198. The first of these documents describes an illuminated fountain in which drops coming from tubes provided with relatively complex valve devices are illuminated by a stroboscopic lamp in order to obtain various attractive luminous effects for decorative purposes only. The device is highly complex since it requires each of the orifices of a rectilinear water feed tube to be associated with a respective valve having an electronic control circuit. In the second above-mentioned document, which also describes a drop-by-drop decorative device, the water comes from a plane disk and the fall of the water is controlled by means of a vibrating device, the drops being illuminated by a stroboscopic light source and the assembly constituting a fountain in which the drops appear to move along vertical-axis helixes. The fountain described in the Belgian patent is also intended to provide an optical effect by spraying a colored liquid, whereas that described in the German patent is mainly intended for humidifying ambient air and/or cleaning it.

The equipment of the present invention does not stem from the principles on which the above-described embodiments are based. It does not seek to take advantage of purely optical phenomena, and consequently it makes no use of stroboscopic light sources not of optical systems of the type used with illuminated fountains. Nor does it make use of complex means for forming drops of water, nor does it seek to clean the ambient air in the space in which it is installed, such that since it is intended to provide multiple functions, e.g. decoration and air conditioning, and since it is also suitable for acting as a leisure space or even as an accessory means for therapeutic treatment, e.g. thalassotherapy (i.e. salt water treatment), equipment according to the invention is quite different from prior art devices both in the problems which it seeks to solve, or the needs which it seeks to satisfy, and the means implemented for achieving these results.

SUMMARY OF THE INVENTION

The present invention provides utilatarian or decorative equipment for atmosphere or leisure using water coming from a manifold member, the water being used in the form of droplets which are adjustable in volume and at least in fall duration and frequency, the equipment comprising, in combination:

a multiplicity of ducts connected to a supply of water, each of the ducts being pierced by outlet ports associated with nozzles for distributing the water under pressure by capilarity and in the form of droplets, fine streams, and/or very fine jets of water defining architectural volumes and/or shapes such as columns, domes, and the like;

at least one collection element beneath the ducts;

means for controlling the formation and fall of the droplets, streams, and very fine jets of water from the ducts; and means for controlling the circulation and flow of water to the ducts from an overall system e.g., in one embodiment from the collection element.

The collection element may be a natural stretch of water such as a lake or a river, or it may be artificial, such as a basin or swimming pool, ... or it may constitute the normal rainwater run-off collecting means provided in a residential building for instance on a terrace or a balcony.

The collection element may be associated with a method and/or device for recycling the water that reaches the element, optionally after treating the water by physical or physico-chemical treatments such as filtering and/or sterilization.

In a preferred embodiment of the invention, the equipment comprises a plurality of distinct modules each of the modules comprising a circuit of ducts above a collection basin, a structure for supporting the ducts and the basin, the structure advantageously in the form of a lattice-work or beam, and a method and/or device for controlling the circulation and flow of the water fed to each of the circuits thereby enabling one to modify the way in which each of the modules is used as a function of practical aesthetic consideration.

Equipment in accordance with the invention may differ as to size and/or as to desired objective.

Thus, the invention envisions equipment of monumental dimensions for public or semi-public architectural purposes which may be located, for example, in leisure parks, in commercial areas, in exhibitions or fairs, and in meeting places in urban sites.

Embodiments of smaller dimensions may be used to decorate buildings, such as swimming pools, centers for treatment such as thalassotherapy, etc., whereas other models of even smaller dimensions are particularly appropriate for individual use, for example as decoration, atmosphere, or leisure elements in individual houses or apartments.

BRIEF DESCRIPTION OF THE DRAWINGS

Embodiments of the invention are described by way of example with reference to the accompanying drawings, in which:

FIG. 8 is a plane view of a "stage" of the equipment shown in FIG. 7 and on yet another scale; and FIG. 9 is a diagrammatic view of yet another embodiment of equipment in accordance with the invention and suitable for use on a terrace, balcony, garden, or the like.

MORE DETAILED DESCRIPTION

Figure 1:
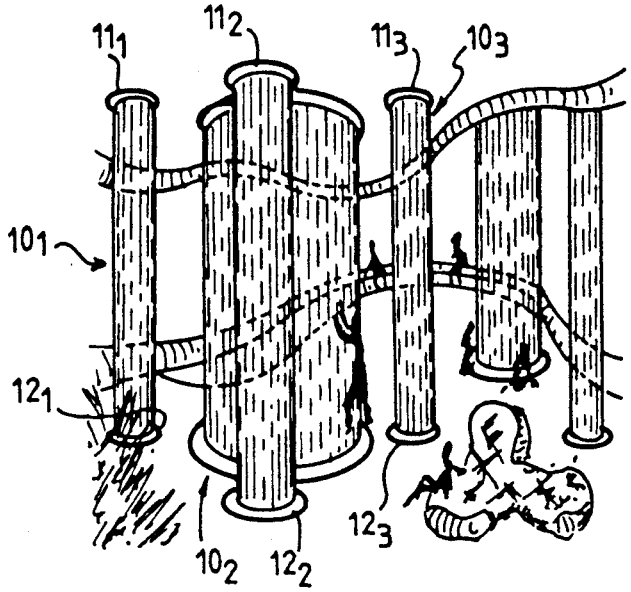
FIG. 1 is a highly diagrammatic perspective view of a first embodiment of equipment using water in accordance with the invention.

Reference is made initially to FIG. 1 which is a highly diagrammatic perspective view of a first embodiment of equipment in accordance with the invention. The equipment comprises, in an open or in an enclosed space, a multiplicity of modules (e.g., $10_1$, $10_2$, $10_3$), each of which comprises at the top a circuit of ducts (e.g., $11_1$, $11_2$, $11_3$), and at the bottom of a basin (e.g., $12_1$, $12_2$, $12_3$). The shape of each of the duct circuits (11) is arbitrary and selected as a function of practical aesthetic considerations concerning the overall effect, for example a sinuous curved line or a criss-cross of such lines, and the basins (12) are shaped to correspond to the apparent outline of the circuits (11), for example they may be circular, elliptical, or any other appropriate shape.

Figure 2:
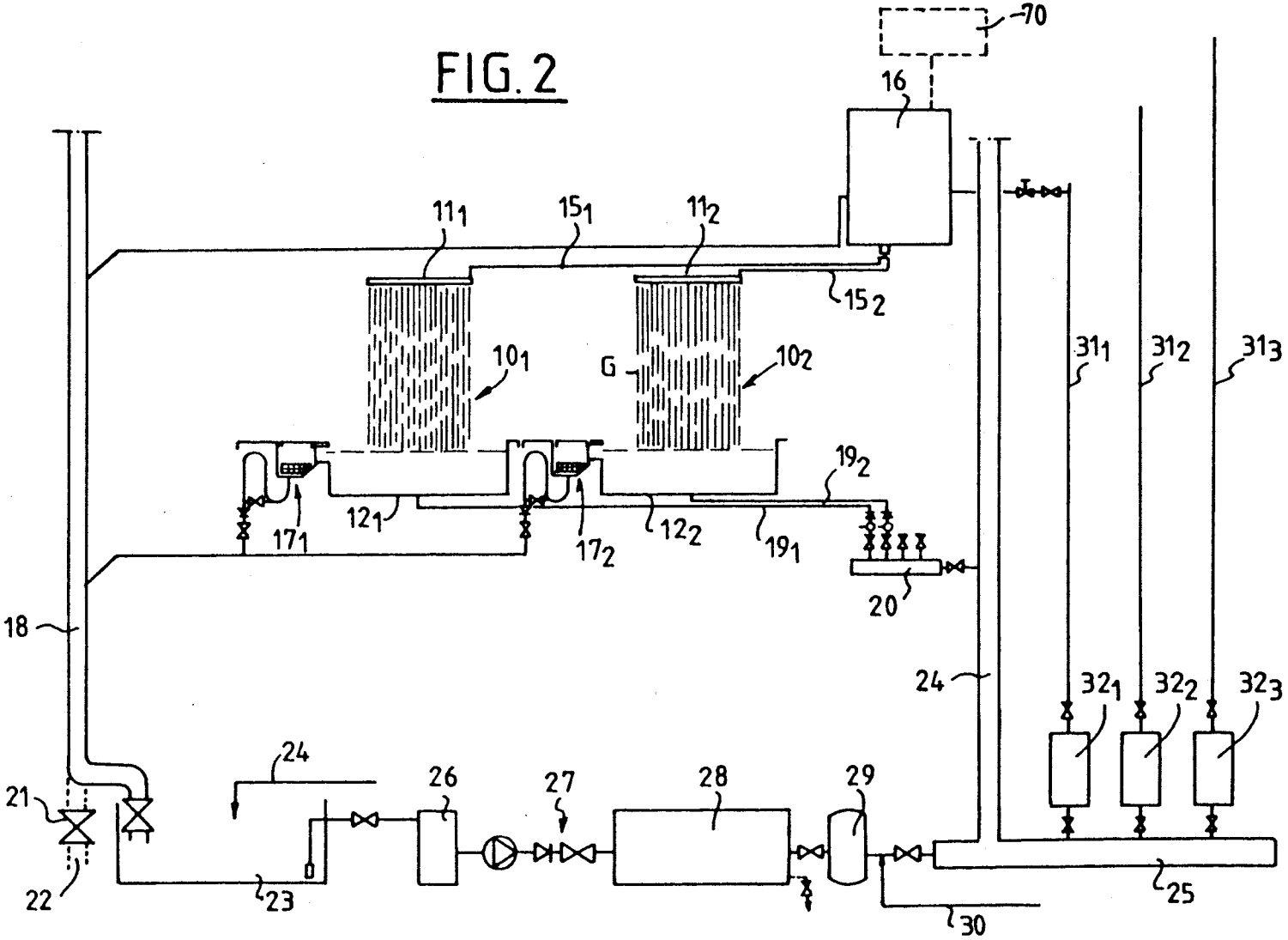
FIG. 2 is a circuit diagram of such equipment.

Also in accordance with the invention, the circuits (11), are provided for the delivery of water in the form of droplets, fine flows or streams, or very fine jets of water, and the basins (12) and the other components of the equipment, as described below, are interconnected by a water circulation system of the type shown in FIG. 2. As can be seen in this figure, the water circulation means comprise feed lines ($15_1$, $15_2$) connecting the circuits (e.g., $11_1$, $11_2$) to a manifold (16) placed above the modules, or to a water supply pipe, whereas, at the bottom of the modules, the basins ($12_1$, $12_2$), which constitute components for recovering the water coming from the circuits (11), are connected via siphons ($17_1$, $17_2$) to a duct (18) which leads, depending on the position of the stop valve (21), either to a waste outlet (22) or else to a tank (23) which can be topped up with water via a pipe (24). The basins ($12_1$, $12_2$) are also connected via pipes ($19_1$, $19_2$) to a manifold (20) which is fed from a pipe (24) connected to one or more general supply manifolds (25). The general supply manifold (25) may be connected directly to a water supply and/or it may be connected to the tank (23) via pre-filters (26), a set of pumps (27), filters (28), and a heat exchanger (29) having an injection tee (30) provided in its outlet for receiving a sterilizing agent or a similar product, with the above-described components together serving to supply the manifold(s) (25) with water taken from the basins (12) as topped up, where necessary, by new water taken from the feed pipe (24), and after the water has been processed by filtering, sterilization, etc.

The distribution manifolds (16) are fed with water from the general supply manifold(s) (25) via one or more lines ($31_1$, $31_2$, $31_3$), each general supply manifold (25) is advantageously associated with one or more distribution manifolds (16) as a function of the heights of the distribution manifolds (16) after having passed through pressure boosters such as $32_1$, $32_2$, $32_3$, etc.

In accordance with the invention, the circuits (11) for distribution droplets, fine flows or streams, or very fine jets of water under pressure and by capilarity taken from the water received via the lines (15) includes tubes (35) (see FIG. 3 and 4) advantageously made of plastic material such as PVC which is suitable for being shaped in a simple manner to follow any desired curve or line, with each circuit (11) comprising either a single tube (35) or advantageously a plurality of such tubes.

Figure 5:
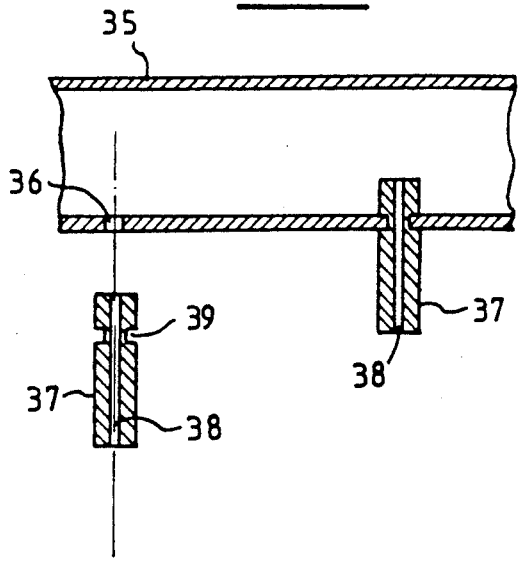
FIG. 5 is a detailed view on a larger scale of a portion of such a part.

In accordance with another charcteristic of the invention, each of these tubes is as shown in FIG. 5; i.e., in addition to the tube (35) per se, each tube also includes a multiplicity of nozzles (37) formed from a cylinder having an axial capillary bore (38) milled to form a neck (39), whereby said nozzles are fitted into outlet ports (36) and from the tube (35).

Figure 3:
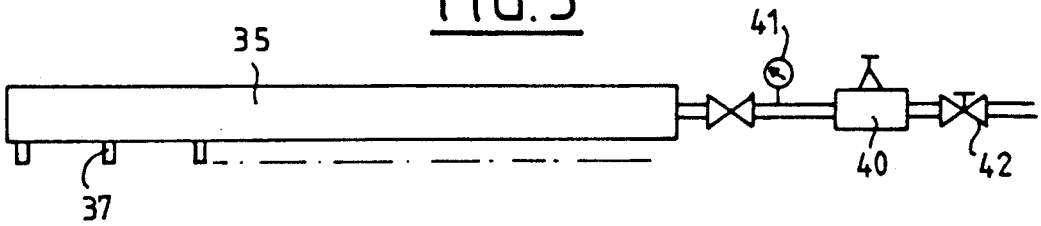
FIG. 3 shows a component part of equipment in accordance with the invention.
Figure 4:
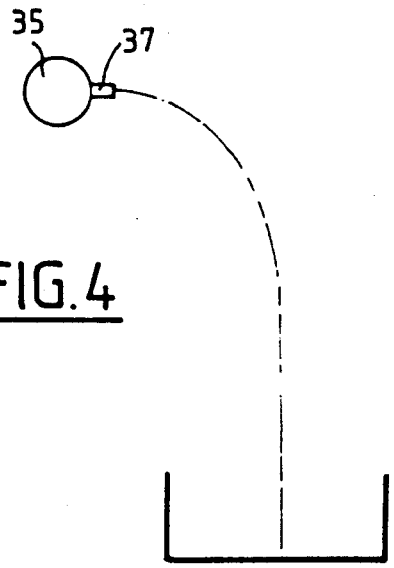
FIG. 4 shows one way of using such a component part.

Each of the tubes or sets of tubes (35) is preferably provided with a pressure reducer (40), a pressure gauge (41) and one or two cocks (42) in order to permit adjustable control of the volume, the frequency, and the fall time of the droplets G and/or similar flows or streams delivered by the tubes, by suitably selecting operating parameters. Numerous form effects may also be modified by an appropriate selection of nozzle distribution, e.g., concerning their respective spacings, and/or their shapes, and/or their three dimensional disposition which may be along a vertical axis as shown in FIG. 3, or along a sloping axis as shown in FIG. 4, thereby obtaining trains of drops which are initially curved on leaving the nozzles, with the assembly as a whole defining various architecture shapes and/or volumes such as columns, domes, etc.

It is possible to implement numerous embodiments of the above-described device which make it possible to use the circuits (11) for obtaining intermittent flows or streams of drops or droplets similar to natural rain which are adjustable with respect to the parameters of volume, frequency, fall time, etc., as mentioned above and also, where applicable, with respect to temperature, odor (perfume addition), and color (addition of a coloring agent).

Figure 7:
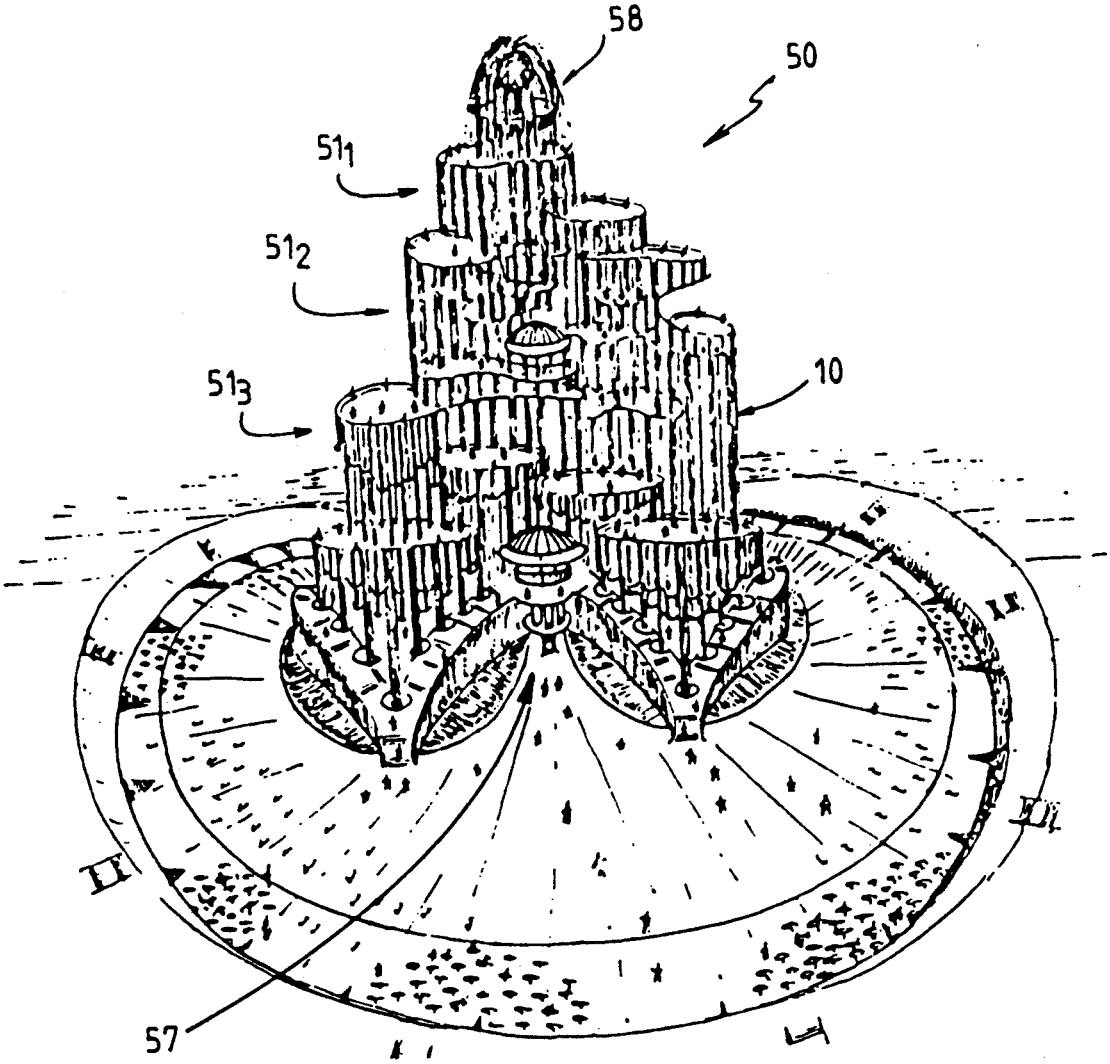
FIG. 7 is a diagrammatic perspective view of yet another embodiment of equipment in accordance with the invention but on a scale very different from that of FIG. 6.
Figures 8, 9:
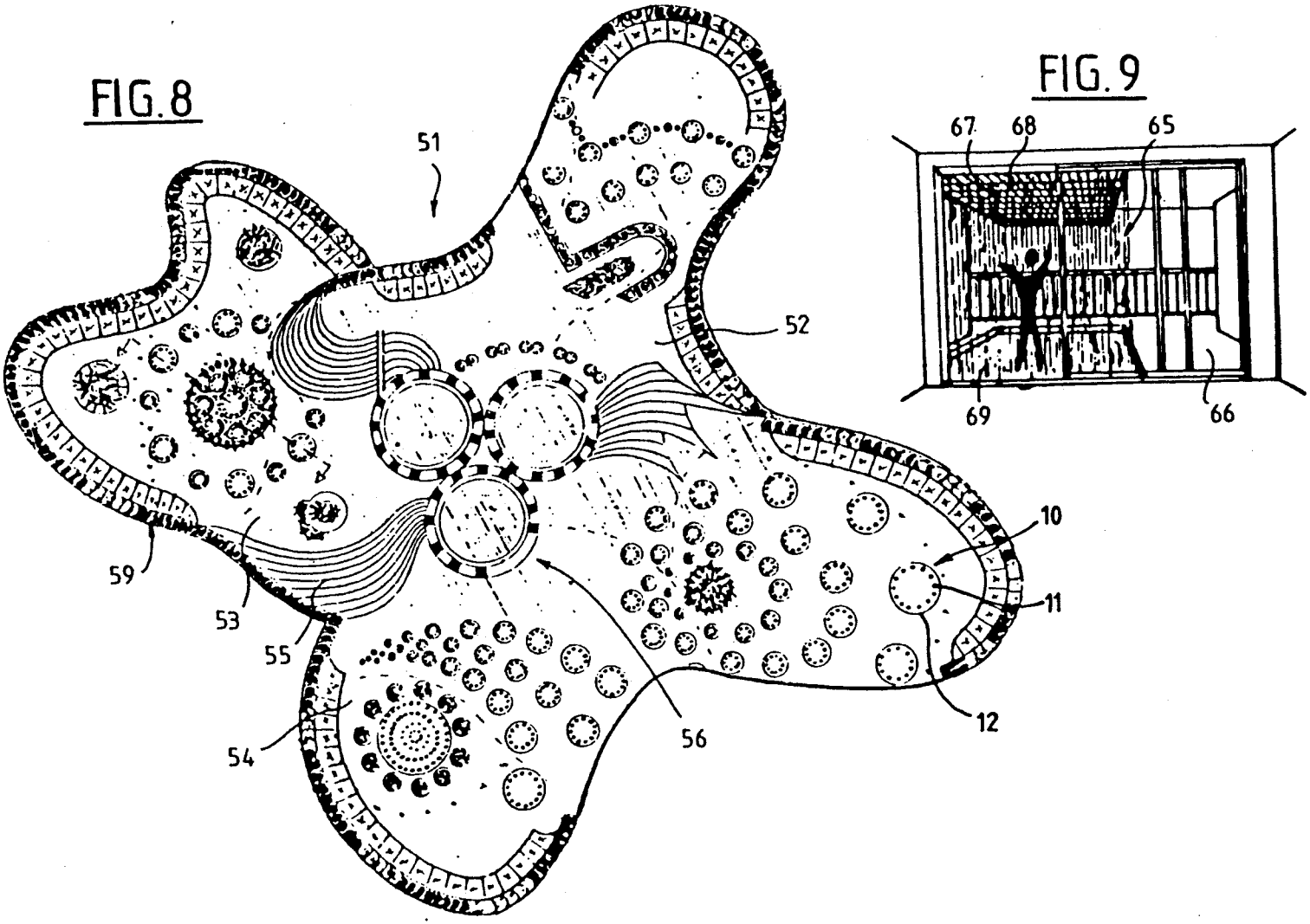

Thus, in addition to the equipment shown in FIG. 1, which is intended, for example, to constitute a decorative and/or leisure equipment of medium size, the invention also provides equipment of monumental size for architectural purposes, as shown in FIG. 7 and 8, which equipment may be located, for example, in leisure parks, or in urban, commercial, or exhibition areas, etc. As shown in these figures, such equipment (50) comprises a plurality of "stages" ($51_1$, $51_2$) each comprising a platform (52) itself comprising one or more floors (e.g., 53 or 54) interconnected by stairs (55) establishing communication within each platform, with the set of stages being distributed around one or more load-carrying structures, for example, three central pillars (56) which are also used for housing vertical movement devices such as elevators and systems for distributing water and other utilities that are needed between the base platform (57) of the equipment and its pinnacle (58) which constitutes, in this case, a giant knob shape suitable for use in the formation of water falls or small jets of water. In such an embodiment, each module comprises a duct circuit and a basin placed wherever the designer chooses on each of the stages (51), together, for example, with additional decorative elements such as seats, benches, flower stands, etc. shown at (59) around the perimeter of each stage or in preferred locations on the stages.

Figure 6:
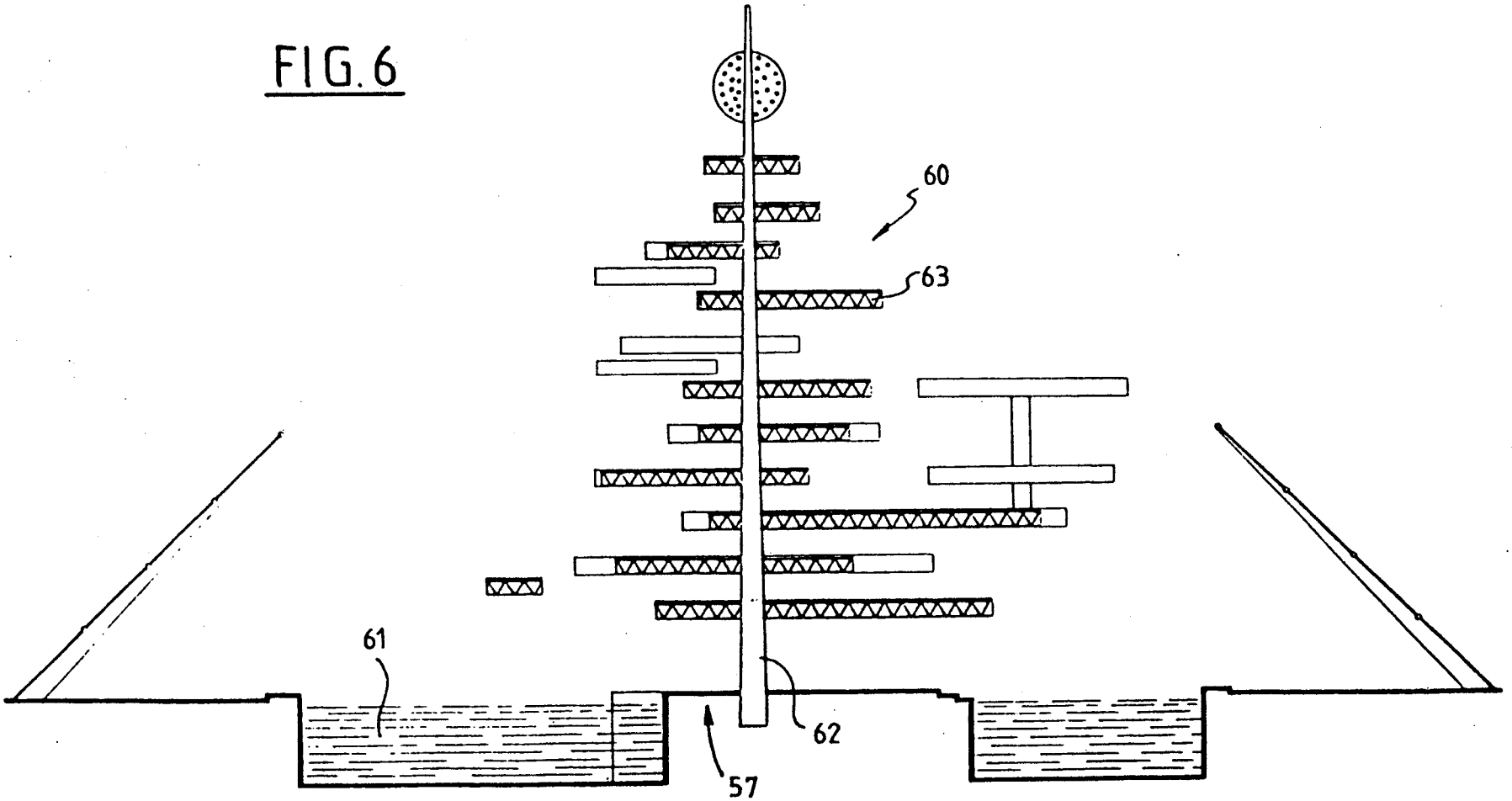
FIG. 6 is a diagrammatic view showing another embodiment of equipment in accordance with the invention.

In an embodiment of smaller size, as shown in FIG. 6, the equipment (60) is contemplated to be fitted in a swimming pool (61). The equipment then comprises a central pillar (62), anchored at its bottom end, as shown in FIG. 6 at 100, (62) having platforms (63) fixed thereto, the platforms being advantageously made from modular units each of which may be provided with one or more basins (12), and with corresponding circuits of ducts for distributing drops, droplets, fine flows or streams, or very fine jets of water being placed thereabove.

In yet another embodiment shown in FIG. 9, the equipment (65) in accordance with the invention is shown as being installed on the terrace (66) of a private apartment, with the duct circuit (67) at the top of the equipment then being fixed by a trellis or granting (68), while the collector element (69) is merely the equipment already provided for ensuring rainwater run-off from the floor of the balcony.

In a variant of this embodiment, the collection element (69) is a basin provided on the floor of the balcony or the terrace housing the equipment and is itself connected by means (not shown) to the ducts for distributing water in the form of droplets, fine flows or streams, or very fine jets of water.

Each embodiment of the invention provides for the circulation and the flow of water in the ducts for distributing drops to be controlled by an automatic control unit (70) (FIG. 2) which may operate purely mechanically for embodiments which are small in size, or which may be based on computerized electronics for embodiments of larger sizes.

Equipment in accordance with the invention and suitable for satisfying multiple functions may be implemented, in particular, in enviroments which are permanently or periodically very hot, since the equipment consumes relatively little water because a large portion of the water is recycled by the characteristic modules of the invention. The invention then contributes not only to the physical well-being of the people occupying the space in which it is installed, e.g. by its effect of regulating the ambient temperature, but also on their psychological or psychic well-being by creating a space whose decoration and animation is original and varied.

I claim:

1. A water fountain device for creating controlled flows of water comprising at least one pair of a liquid dispenser and collector operatively positioned with respect to one another at vertically spaced apart locations, each dispenser including a supply manifold and a supply line, each supply line including pressure and flow controllers, each supply manifold including a plurality of ports and an equal plurality of nozzles respectively associated with said ports, each of said nozzles including means defining a capillary outlet from said associated port of said supply manifold, said plurality of nozzles being positioned on the said supply manifold downstream of said pressure and flow controllers so that the volume, duration, frequency and three dimensional disposition of flow of liquid from said supply manifold are adjustable, each collector being connected to at least one collection line and each collection line including control means for controlling the circulation and flow of liquid within said device to each of said supply lines.

2. A fountain as in claim 1 further including a plurality of said dispensers and collectors.

3. A fountain as in claim 2 wherein predetermined pairs within said plurality of pairs are positioned at different horizontal levels from the remaining pairs.

4. A fountain as in claim 1 wherein said collection line includes means for varying physical condition of the water.

5. Equipment according to claim 1 wherein said collector comprises a natural or artificial body of water.

6. Equipment according to claim 1 wherein said collector comprises one or more basins or tanks.

7. A fountain as in claim 1 wherein said collection line further includes filters.

8. A fountain as in claim 7 wherein said collection line further includes a heat exchanger.

9. A fountain as in claim 7 wherein said collection line further includes control means for varying the temperature, color and odor of the liquid.

10. A fountain as in claim 1 wherein the capillary outlet for each of said nozzles includes a capillary throughbore, and wherein said nozzles are positioned on said supply manifold so that the axis of said capillary throughbore extends along a sloping axis to produce at least an initially curved flow of liquid.

11. A fountain as in claim 1 wherein the capillary outlet for said nozzles include a capillary throughbore with the nozzles being positioned on said supply manifold so that the axis of the capillary throughbore extends along a substantially vertical axis.

12. A fountain as in claim 1 further including a plurality of said at least one pairs of a dispenser and a collector, a supporting structure for supporting said plurality of pairs, said supporting structure including at least one vertically extending pillar having a top end and a bottom end, anchoring means suitably anchoring the bottom end, and supporting means supporting said plurality of pairs at predetermined positions on said at least one pillar.

13. A fountain as in claim 12 wherein said supporting structure includes a plurality of said pillars.

14. A fountain as in claim 12 wherein said supporting means supports said plurality of pairs of different horizontal positions on said pillar.

15. A fountain as in claim 13 wherein said supporting means supports said plurality of pairs at different horizontal positions on said plurality of said pillars.

16. A fountain as in claim 15 wherein said supporting structure further includes flooring means defining flooring areas for supporting one or more of said dispenser and collector pairs.

17. An ornamental balcony structure comprising a floor, a ceiling, means defining a trellis mounted so as to depend from and extend across at least a portion of the ceiling, at least one liquid distributor mounted between said ceiling and said trellis means, said at least one liquid distributor including a supply manifold and a supply line, said supply line including pressure and flow controllers, each supply manifold including a plurality of nozzles, each including means defining a capillary outlet from said supply manifold, said plurality of nozzles being positioned on said supply manifold downstream of said pressure and flow controllers so that the volume, duration, frequency and three dimensional disposition of liquid from said supply manifold are adjustable, a collector mounted within said floor and means for controlling the flow of liquid to said supply line.

18. A water fountain device for creating controlled flows of water comprising at least one pair of a liquid dispenser and collector operatively positioned with respect to one another at vertically spaced apart locations, each dispenser including a supply manifold and a supply line, each supply line including pressure and flow controllers, each supply manifold including a plurality of nozzles with each of said nozzles including means defining a capillary outlet from said supply manifold, said plurality of nozzles being positioned on said supply manifold downstream of said pressure and flow controllers so that the volume, duration, frequency and three dimensional disposition of flow of liquid from said supply manifold are adjustable, each collector being connected to at least one collection line which includes filters, and each collection line including control means for controlling the circulation and flow of liquid within said device to each said supply line, and means for varying the temperature, color and odor of the liquid.

19. A water fountain device for creating controlled flows of water comprising a plurality of pairs of a liquid dispenser and a liquid collector, together with a supporting structure for supporting said plurality of pairs, the supporting structure including at least one vertically extending pillar having a top end and a bottom end, means for suitably anchoring the bottom end and means for supporting said plurality of pairs at predetermined positions on said at least one pillar.

each said pair of a dispenser and collector operatively positioned with respect to one another at vertically spaced apart locations, each dispenser including a supply manifold and a supply line, each supply line including pressure and flow controllers, each supply manifold including a plurality of nozzles with each of said nozzles including means defining a capillary outlet from said supply manifold, said plurality of nozzles being positioned on said supply manifold downstream of said pressure and flow controllers so that the volume, duration, frequency and three dimensional disposition of flow of liquid from said supply manifold are adjustable, each collector being connected to at least one collection line and each collection line including control mean for controlling the circulation and flow of liquid within said device to each said supply line.

20. A fountain, as in claim 19 wherein said supporting structure includes a plurality of said pillars.

21. A fountain as in claim 19 wherein said supporting means supports said plurality of pairs at different horizontal positions on said pillar.

22. A fountain as in claim 20 wherein said supporting means supports said plurality of pairs at different horizontal positions on said plurality of said pillars.

23. A fountain as in claim 22 wherein said supporting structure further includes means defining flooring areas for supporting one or more of said dispenser and collector pairs.

* * * * *